US006039297A

United States Patent [19]

Johnson

[11] Patent Number: 6,039,297

[45] Date of Patent: Mar. 21, 2000

[54] HANDY FLASHLIGHT HOLDER

[76] Inventor: Robert E. Johnson, 110 Fourth St., Dearborn Heights, Mich. 48127

[21] Appl. No.: 09/163,178

[22] Filed: Sep. 30, 1998

[51] Int. Cl.[7] ..... A47F 5/00

[52] U.S. Cl. ..... 248/314; 248/544

[58] Field of Search ..... 248/314, 311.2, 248/544, 551, 916; 362/435, 396, 191

[56] References Cited

U.S. PATENT DOCUMENTS

| | | | |
|---|---|---|---|
| 3,692,266 | 9/1972 | Jacobs | 248/544 X |
| 5,088,673 | 2/1992 | Chandler | 248/311.2 |
| 5,188,327 | 2/1993 | White | 248/314 X |
| 5,195,817 | 3/1993 | Deccio | 362/72 |
| 5,276,596 | 1/1994 | Krenzel | 362/191 |
| 5,326,064 | 7/1994 | Sapien | 248/311.2 |
| 5,460,346 | 10/1995 | Hirsch | 248/229.13 |
| 5,601,356 | 2/1997 | McWilliams | 362/103 |
| 5,713,658 | 2/1998 | Stranagan, Jr. | 362/396 X |

*Primary Examiner*—Ramon O. Ramirez
*Attorney, Agent, or Firm*—Patent & Trademark Services; Thomas Zack; Joseph H. McGlynn

[57] ABSTRACT

A flashlight holder having a hollow interior walled casing which extends around the sides of a held flashlight. Apertures or holes in the casing's sides permit the tip and front part of a screwdriver to be insert into from one side of the casing to turn screws in an aligned side hole to mount the holder flush against a supporting surface, such as a wall. Upper opposite cut out portions of the casing allow the side switch on any retained flashlight to clear the adjacent casing wall if inserted in either of two different opposite orientations. A lower support rod fixed into the casing's side walls extends completely across the hollow interior of the casing and is used to support the lower base of a retained flashlight.

2 Claims, 1 Drawing Sheet

HANDY FLASHLIGHT HOLDER

BACKGROUND OF THE INVENTION

Flashlights are one of those devices just about everyone has and uses when needed. Finding the easily transported flashlight is another problem. It can be also anywhere a person conveniently drops it off. Having no light to see, such as when there is a home or business electrical power failure, creates an additional obstacle to finding the elusive flashlight.

One suggestion to insure the flashlight can be found when needed is to place the flashlight in a holder or clip which can either be worn by a user or whose holder location is known and can easily be found under most circumstances.

The present invention relates to one such improved flashlight holder that is easy to install on walls, in cupboards, near fire boxes, near fuse boxes, near meters, near stairs, near attic doors, in laundry rooms, in closets or just about any other convenient location in the homes or business as will be described in detail hereafter.

DESCRIPTION OF THE PRIOR ART

Devices that are capable of holding or retaining flashlights are known. For example, in the Deccio invention (U.S. Pat. No. 5,195,817) a flashlight holder apparatus is disclosed having two C-shaped clamps that hold a flashlight to a motorcycle frame.

The Krenzel patent (U.S. Pat. No. 5,276,569) discloses an elongated flexible member that can be formed in different shapes with an end holder used to hold a flashlight.

In U.S. Pat. No. 5,460,346 to Hirsch the dual purpose article holder described has a clip to lock the holder and its held flashlight to a clamp.

In the McWilliams reference (U.S. Pat. No. 5,601,356) a flashlight stand and wrist mount system is disclosed that has straps used to encircle the forearm of a user with an attached flashlight.

The present invention relates to a flashlight holder that can easily be installed in a great variety of locations to permit its easy retrieval when needed as more fully set forth in this specification.

SUMMARY OF THE INVENTION

This invention relates to a flashlight holder having a hollow casing which extends around a held flashlight. Apertures in the casing's sides permit a screwdriver head to insert into from one side of the casing to turn screws in aligned side apertures to mount the holder to a supporting surface. An upper cut out portion of the casing allows the retained flashlight's side switch to clear the casing.

It is the primary object of the present invention to provide for an improved flashlight holder.

Another object is to provide for such a holder that can easily be attached to a supporting surface.

These and other objects and advantages of the present invention will become apparent to readers from a consideration of the ensuing description and the accompanying drawings.

DESCRIPTION OF THE PREFERRED EMBODIMENT

Figure 1:
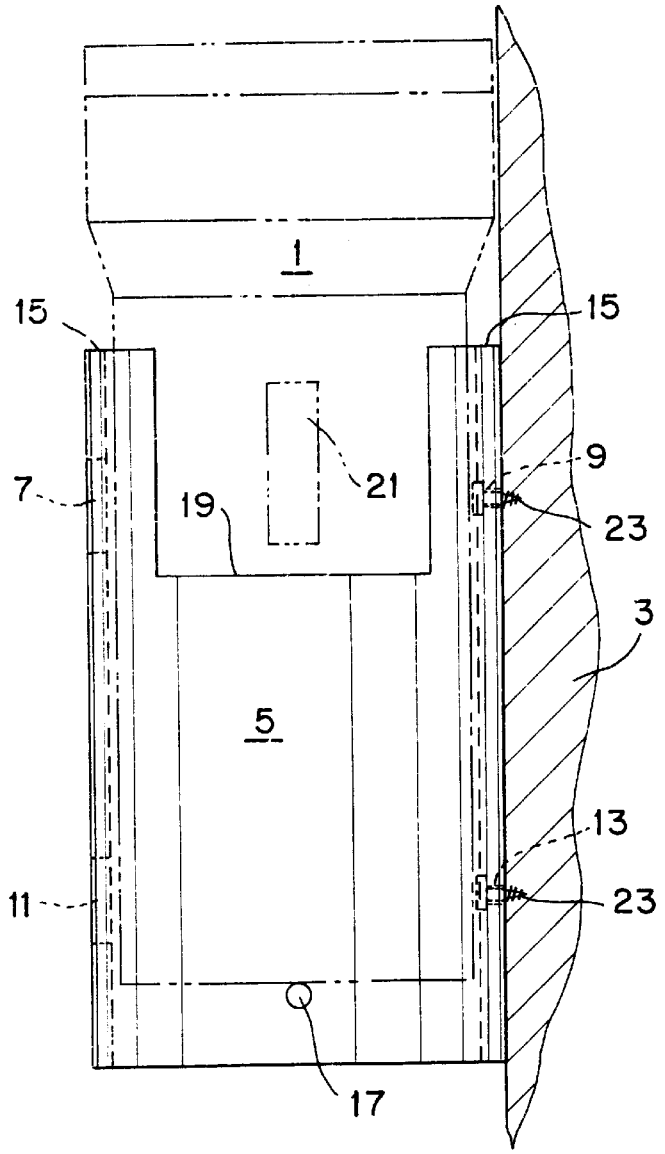
FIG. 1 is a side view of the invention's preferred embodiment showing a retained flashlight as attached to a supporting vertical surface.

FIG. 1 is a side view of the invention's preferred embodiment showing, in dotted line format, a retained flashlight 1 as attached to a supporting vertically disposed support surface 3, such as a wall. The holder 5 is a generally hollow cylindrically shaped casing. There are upper horizontally disposed aligned side holes 7 and 9 and spaced therefrom lower horizontally disposed aligned side holes 11 and 13. These four holes or apertures constitutes two spaced sets of aligned holes. Each of the four holes extends through the casing wall 15 with two extending from the outside casing wall surface into the hollow interior of the casing and two from the inner casing wall adjacent the supporting surface.

Adjacent the opened lower end of the casing and extending completely across the casing's hollow interior is a rigid straight lower support rod 17 , whose near end is shown, that is fixed into the casing wall 15 at both of its opposite ends. This rod acts as a lower support for the base of the flashlight 1 when inserted into the hollow holder 5 to prevent the flashlight from falling through the holder's hollow opened casing.

Cut into the upper portion of the holder's casing is a notched out portion 19 having three sides used to permit the flashlight's side switch 21 to be inserted into the holder's casing. This notched out portion may extend through the two opposite casing walls 15 to permit the flashlight to be inserted with its switch facing in either of two opposite directions. Two small screws 23, shown in dotted line format, are seated in and extend through the inner smaller diameter vertically aligned apertures 9 and 13 and are used to hold the holder 5 flush against the vertical supporting surface 3. The enlarged heads of these screws bear against the inner side of wall 15. Molly bolts, anchors, etc. may be used in conjunction with the screws 23 to retain the holder to the supporting surface depending on the characteristics of the material of the surface into which the screws are placed.

It is to be noted that the diameters of each of the two holes or apertures 7 and 11 are the same and are about twice as large as the individual diameters of each of the horizontally aligned smaller holes 9 and 13, respectively. Using larger diameters for the outside spaced holes 7 and 11 permits the front end and tip of a screwdriver to be inserted within the hollow interior of the casing 5 to turn the two support screws 23 in the smaller holes 9 and 13.

Clearly, as used in this application the terms horizontally disposed and vertically disposed when referring to the alignment of the hole sets or aperture sets 7/9 and 11/13 and the support surface 3 are interchangeable depending on the orientation of the holder's supporting surface 3. Thus, if surface 3 were a generally horizontally disposed supporting surface, like the horizontal surface under a kitchen cabinet, the two sets of spaced and aligned larger and smaller diameter holes 7/9 and 11/13 would then be aligned and facing in a generally vertically disposed direction. The lower support rod 17 is generally cylindrically shaped and perpendicularly oriented with respect to a straight line running from the larger diameter outer casing wall hole to the smaller inner casing wall screw receiving hole in both hole sets.

Figure 2:
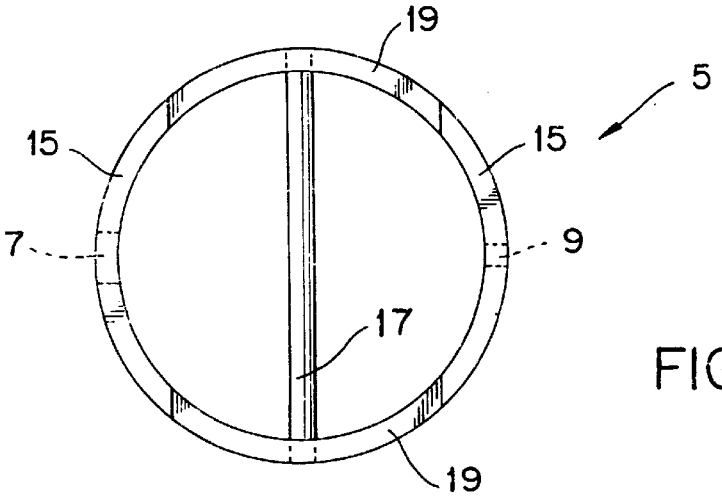
FIG. 2 is a top view of the holder of FIG. 1 without the flashlight and supporting surface.

FIG. 2 is a top view of the holder of FIG. 1 without the flashlight 1 and supporting surface 3. The screws 23 used to hold the holder 5 against the supporting surface have also been omitted from this figure. The elongated lower support rod 17 is shown extending completely across the hollow inner diameter of the casing 5 with its ends fixed into opposite casing walls 15. The two upper opposite cut away portions 19 are facing in the same direction as the rod and aligned with each other. Only the aligned upper holes (7/9) are shown it being understood that the lower aligned holed set (11/13) is directly below and therefore not visible. The casing wall 15, in this view, is generally circular and has a definite thickness to accommodate the holes and notches in it and to act to hold the rod 17.

Normally the holder 5 can be used to hold any flashlight that uses C or D sized batteries. However, with some variations in its dimensions other sized flashlights can also be held. A lightweight but strong plastic material, like ABS (Acrylonitrile-butadiene-styrene) plastic, may be used to construct the holder using plastic injection molding techniques.

The holder can be mounted in almost any convenient location within a home or business that has a support surface, vertical or horizontal, into which the screws can be inserted. Examples, include walls, cupboards, near basement fuse boxes, near stairwells, near attic doors, in laundry (to read the machines dials) or pantry rooms, closets, etc. or wherever it is convenient to store a source of temporary lighting. Since, the location of the flashlight is fixed in the holder and the holder is fixed at one or more specific locations in the home or business there is little problem is locating the light source when needed in an emergency.

In addition to flashlight using batteries for their power source, rechargeable flashlights can also be inserted within the holder providing that there is a light plug power outlet into which the flashlight's power cord and power pack can be connected.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. The combination of a flashlight and a flashlight holder comprising:

a flashlight holder with a casing, said casing having side walls with a hollow interior and an upper end and a lower end, said casing's upper end being opened and adapted to receive the inserted body of a flashlight within the hollow interior of the casing;

a lower support member for engagement with the base of an inserted flashlight extending around the hollow interior of the casing and fixed to opposite casing walls; and a casing cut out portion above the lower support member; and a flashlight having a side switch insertable into the casing and supported by the lower support member with the side switch extending into said casing's cut out portion whereby said flashlight is received within the casing, and wherein said casing's lower end is opened with the lower supporting member being adjacent thereto, and wherein said lower support member is a cylindrically shaped rod that extends across the hollow interior of the casing.

2. The combination as claimed in claim 1, wherein said casing side walls have a first hole set with a large outer hole and an aligned inner smaller hole, said outer hole being used to insert a screwdriver into the hollow casing interior to turn a screw seated in the aligned inner smaller hole when the casing at its smaller hole is flush against a support surface; and a second spaced set of aligned holes extending through said side casing walls with a larger outer hole and an aligned inner smaller hole, said aligned smaller hole of said second set also being aligned with the smaller hole of the first set.

* * * * *